US010724350B2

(12) United States Patent
Tolman et al.

(10) Patent No.: US 10,724,350 B2
(45) Date of Patent: Jul. 28, 2020

(54) PERFORATION DEVICES INCLUDING TRAJECTORY-ALTERING STRUCTURES AND METHODS OF UTILIZING THE SAME

(71) Applicants: Randy C. Tolman, Spring, TX (US); Timothy G. Benish, Spring, TX (US)

(72) Inventors: Randy C. Tolman, Spring, TX (US); Timothy G. Benish, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 178 days.

(21) Appl. No.: 16/116,569

(22) Filed: Aug. 29, 2018

(65) Prior Publication Data

US 2019/0153828 A1 May 23, 2019

Related U.S. Application Data

(60) Provisional application No. 62/589,800, filed on Nov. 22, 2017.

(51) Int. Cl.

| | |
|---|---|
| ***E21B 43/117*** | (2006.01) |
| ***E21B 43/116*** | (2006.01) |
| ***E21B 43/119*** | (2006.01) |
| ***E21B 43/1185*** | (2006.01) |

(52) U.S. Cl.

CPC ..... *E21B 43/117* (2013.01); *E21B 43/116* (2013.01); *E21B 43/119* (2013.01); *E21B 43/1185* (2013.01)

(58) Field of Classification Search

CPC .... E21B 43/117; E21B 43/116; E21B 43/119; E21B 43/1185; E21B 12/10; E21B 43/11; E21B 7/06; E21B 7/061; E21B 7/04

See application file for complete search history.

(56) References Cited

U.S. PATENT DOCUMENTS

| | | | | |
|---|---|---|---|---|
| 2,041,209 A | | 5/1931 | Ridley et al. | |
| 2,140,813 A | * | 12/1938 | Ruther | E21B 43/116 175/4.55 |
| 2,426,517 A | | 12/1944 | McWhorter | |
| 2,913,959 A | | 1/1954 | Mohaupt | |

(Continued)

FOREIGN PATENT DOCUMENTS

RU 2 160 360 C2 12/2000

*Primary Examiner* — Wei Wang

(74) *Attorney, Agent, or Firm* — ExxonMobil Upstream Research Company—Law Department

(57) ABSTRACT

Perforation devices including trajectory-altering structures and methods of utilizing the same. The perforation devices include a magazine, a barrel, a trajectory-altering structure, and an action. The magazine is configured to contain a plurality of cartridges. The barrel extends between a breech, which is configured to receive a selected cartridge of the plurality of cartridges that includes a selected projectile, and a muzzle, which is configured, upon firing of the selected cartridge, to permit the selected projectile to exit the barrel at a muzzle velocity and with a muzzle trajectory. The trajectory-altering structure is configured to act upon the selected projectile such that, upon exiting the trajectory-altering structure, the selected projectile defines a modified trajectory that differs from the muzzle trajectory. The action is configured to transfer the selected cartridge from the magazine to the breech of the barrel and fire the selected cartridge.

24 Claims, 10 Drawing Sheets

(56) References Cited

U.S. PATENT DOCUMENTS

| | | | |
|---|---|---|---|
| 5,396,954 | A | 3/1995 | Brooks |
| 5,909,774 | A | 6/1999 | Griffith et al. |
| 6,378,627 | B1 | 4/2002 | Tubel et al. |
| 6,513,599 | B1 | 2/2003 | Bixenman et al. |
| 6,575,251 | B2 | 6/2003 | Watson et al. |
| 6,581,689 | B2 | 6/2003 | Hailey, Jr. |
| 6,601,646 | B2 | 8/2003 | Streich et al. |
| 6,644,404 | B2 | 11/2003 | Schultz et al. |
| 6,666,274 | B2 | 12/2003 | Hughes |
| 6,695,067 | B2 | 2/2004 | Johnson et al. |
| 6,749,023 | B2 | 6/2004 | Nguyen et al. |
| 6,752,206 | B2 | 6/2004 | Watson et al. |
| 6,789,623 | B2 | 9/2004 | Hill, Jr. et al. |
| 6,817,410 | B2 | 11/2004 | Wetzel et al. |
| 6,830,104 | B2 | 12/2004 | Nguyen et al. |
| 6,843,317 | B2 | 1/2005 | MacKenzie |
| 6,883,608 | B2 | 4/2005 | Parlar et al. |
| 6,935,432 | B2 | 8/2005 | Nguyen |
| 6,983,796 | B2 | 1/2006 | Bayne et al. |
| 6,986,390 | B2 | 1/2006 | Doane et al. |
| 6,997,263 | B2 | 2/2006 | Campbell et al. |
| 7,044,231 | B2 | 5/2006 | Doane et al. |
| 7,051,805 | B2 | 5/2006 | Doane et al. |
| 7,055,598 | B2 | 6/2006 | Ross et al. |
| 7,096,945 | B2 | 8/2006 | Richards et al. |
| 7,100,691 | B2 | 9/2006 | Nguyen et al. |
| 7,104,324 | B2 | 9/2006 | Wetzel et al. |
| 7,243,732 | B2 | 7/2007 | Richard |
| 7,252,142 | B2 | 8/2007 | Brezinski et al. |
| 7,264,061 | B2 | 9/2007 | Dybevik et al. |
| 7,343,983 | B2 | 3/2008 | Livingstone |
| 7,363,967 | B2 | 4/2008 | Burris, II et al. |
| 7,367,395 | B2 | 5/2008 | Vidrine et al. |
| 7,385,523 | B2 | 6/2008 | Thomeer et al. |
| 7,392,852 | B2 | 7/2008 | Richard |
| 7,407,007 | B2 | 8/2008 | Tibbles |
| 7,431,085 | B2 | 10/2008 | Coronado et al. |
| 7,431,098 | B2 | 10/2008 | Ohmer et al. |
| 7,441,605 | B2 | 10/2008 | Coronado et al. |
| 7,562,709 | B2 | 7/2009 | Saebi et al. |
| 7,584,799 | B2 | 9/2009 | Coronado et al. |
| 7,591,321 | B2 | 9/2009 | Whitsitt et al. |
| 7,703,507 | B2 | 4/2010 | Strickland |
| 7,735,559 | B2 | 6/2010 | Malone |
| 7,814,970 | B2 | 10/2010 | Strickland |
| 8,037,934 | B2 | 10/2011 | Strickland |
| 8,162,051 | B2 | 4/2012 | Strickland |
| 8,272,439 | B2 | 7/2012 | Strickland |
| 2004/0007829 | A1 | 1/2004 | Ross |
| 2005/0039917 | A1 | 2/2005 | Hailey, Jr. |
| 2005/0263287 | A1 | 12/2005 | Achee, Jr. et al. |
| 2007/0056750 | A1 | 3/2007 | John et al. |
| 2008/0125335 | A1 | 5/2008 | Bhaysar |
| 2008/0142222 | A1 | 6/2008 | Howard et al. |
| 2008/0257546 | A1 | 10/2008 | Cresswell et al. |
| 2008/0314589 | A1 | 12/2008 | Guignard et al. |
| 2009/0084556 | A1 | 4/2009 | Richards et al. |
| 2009/0159279 | A1 | 6/2009 | Assal |
| 2009/0159298 | A1 | 6/2009 | Assal |
| 2009/0283279 | A1 | 11/2009 | Patel et al. |
| 2010/0078171 | A1* | 4/2010 | Moody ..... E21B 33/138 166/285 |
| 2010/0155064 | A1 | 6/2010 | Nutley et al. |
| 2011/0035152 | A1 | 2/2011 | Durocher et al. |

* cited by examiner

PERFORATION DEVICES INCLUDING TRAJECTORY-ALTERING STRUCTURES AND METHODS OF UTILIZING THE SAME

CROSS REFERENCE TO RELATED APPLICATION

This application claims the benefit of U.S. Provisional Application Ser. No. 62/589,800, filed Nov. 22, 2017, the disclosure of which is incorporated herein by reference in its entirety.

FIELD OF THE DISCLOSURE

The present disclosure relates generally to perforation devices for downhole tubing and more particularly to perforation devices that utilize trajectory-altering structures to alter a trajectory of projectiles fired by the perforation devices and/or to methods of utilizing the perforation devices.

BACKGROUND OF THE DISCLOSURE

Perforation devices may be utilized to form one or more perforations within downhole tubing extending within a wellbore that extends within a subterranean formation. Such perforations may permit and/or facilitate fluid communication between the subterranean formation and a downhole conduit that is defined by the downhole tubing. One way in which perforations historically have been formed is by utilizing shape charge perforation devices. Such shape charge perforation devices include a plurality of shape charges, which must be spaced-apart along a length of the shape charge perforation device. As such, increasing a number of shape charges in the shape charge perforation device requires that the length of the shape charge perforation device be increased. In certain applications, it may be desirable to form a greater number of perforations than readily may be accommodated by the shape charge perforation device. As an example, a length of the shape charge perforation device required to permit the shape charge perforation device to include a desired number of shaped charges may be prohibitively long. As a more specific example, and when forming perforations in wellbores that include horizontal regions, the length of the shape charge perforation device may preclude motion of the shape charge perforation device through and/or past a heel of the wellbore, thereby precluding formation of perforations within the horizontal region of the wellbore. Thus, there exists a need for perforation devices that include trajectory-altering structures and/or for methods of utilizing the perforation devices that include trajectory-altering structures. There further exists a need for perforation devices that may provide capability for selectively providing one, several, dozens or even in some instances hundreds of perforations, without having to run multiple perforating guns in the wellbore or without having to wait on time consuming processes such as jet perforating with an abrasive fluid wash. The following disclosure provides solutions and improvements in the wellbore perforating industry, toward overcoming these limitations, as well as other advantages as discussed below.

SUMMARY OF THE DISCLOSURE

Perforation devices that include trajectory-altering structures and methods of utilizing the same. The perforation devices are configured to be positioned within a downhole conduit of downhole tubing and to form a plurality of perforations in the downhole tubing. The perforation devices include a magazine, a barrel, a trajectory-altering structure, and an action.

The magazine is configured to contain a plurality of cartridges. The barrel extends between a breech and a muzzle. The breech is configured to receive a selected cartridge of the plurality of cartridges. The selected cartridge includes a selected projectile. The muzzle is configured, upon firing of the selected cartridge, to permit the selected projectile to exit the barrel at a muzzle velocity and with a muzzle trajectory.

The trajectory-altering structure is configured to receive the selected projectile from the muzzle. The trajectory-altering structure further is configured to act upon the selected projectile such that, upon exiting the trajectory-altering structure, the selected projectile defines a modified trajectory that differs from the muzzle trajectory.

The action is configured to selectively and sequentially transfer the selected cartridge from the magazine to the breech of the barrel and fire the selected cartridge. The magazine, the barrel, the trajectory-altering structure, and the action are operatively coupled to one another and are configured to move as a unit within the downhole conduit.

The methods include methods of perforating downhole tubing that extends within a wellbore that extends within a subterranean formation. The methods include positioning a perforation device within a downhole conduit that is defined by the downhole tubing. The methods also include sequentially transferring a selected cartridge of a plurality of cartridges from a magazine of the perforation device to a breech of a barrel of the perforation device. The methods further include firing the selected cartridge to accelerate a selected projectile of the selected cartridge from a muzzle of the barrel at a muzzle velocity and with a muzzle trajectory. The methods also include altering the muzzle trajectory with a trajectory-altering structure such that the selected projectile has a modified trajectory that differs from the muzzle trajectory. The methods further include penetrating the downhole tubing with the selected projectile to form a perforation in the downhole tubing.

DETAILED DESCRIPTION AND BEST MODE OF THE DISCLOSURE

Figure 1:
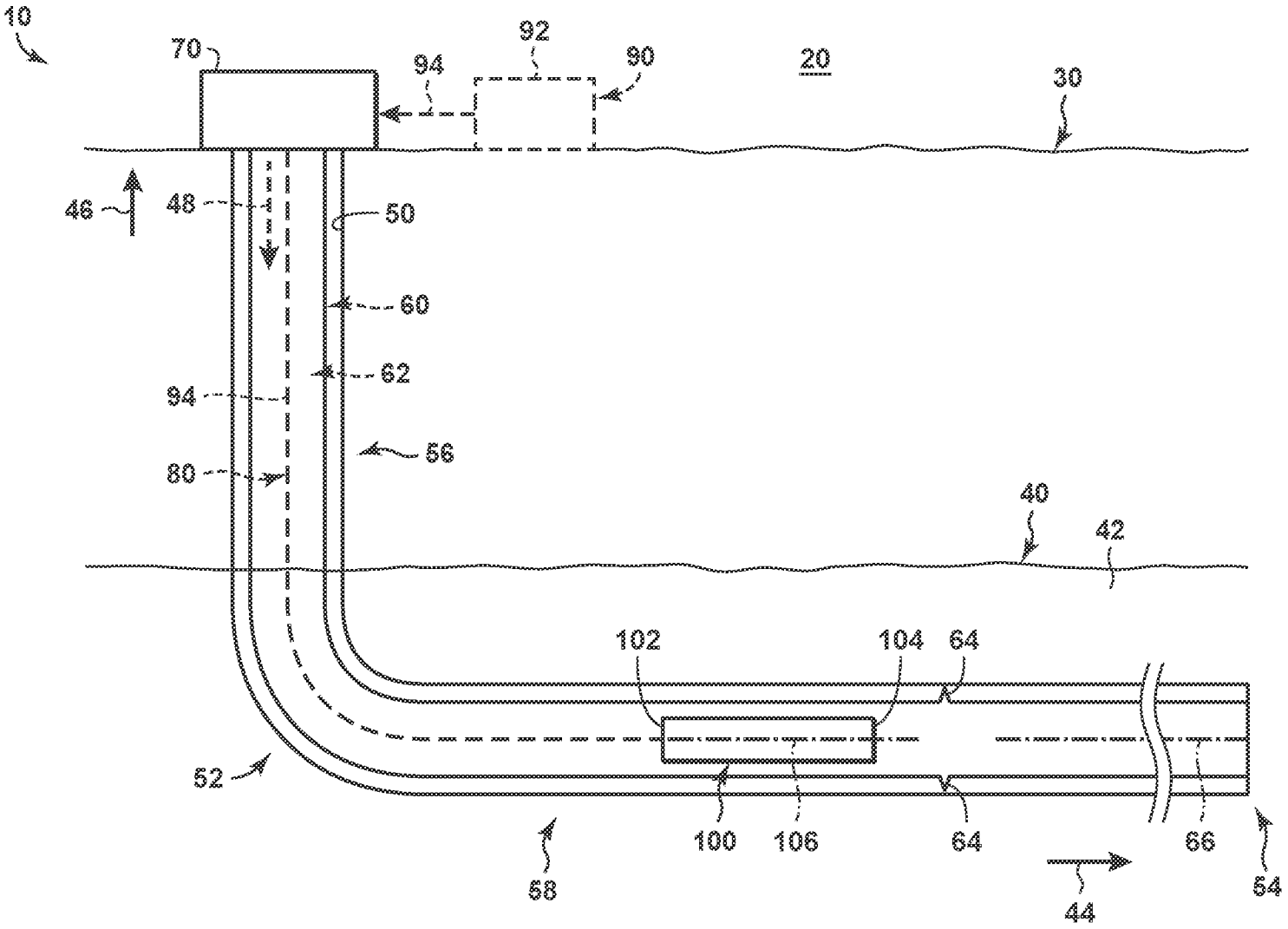
FIG. 1 is a schematic cross-sectional view of a hydrocarbon well that may include and/or utilize perforation devices and/or methods, according to the present disclosure, to form one or more perforations.

FIGS. 1-10 provide examples of perforation devices 100, of hydrocarbon wells 10 that may include and/or utilize perforation devices 100, and/or of methods 200 of perforating downhole tubing, according to the present disclosure. Elements that serve a similar, or at least substantially similar, purpose are labeled with like numbers in each of FIGS. 1-10, and these elements may not be discussed in detail herein with reference to each of FIGS. 1-10. Similarly, all elements may not be labeled in each of FIGS. 1-10, but reference numerals associated therewith may be utilized herein for consistency. Elements, components, and/or features that are discussed herein with reference to one or more of FIGS. 1-10 may be included in and/or utilized with any of FIGS. 1-10 without departing from the scope of the present disclosure. In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

FIG. 1 is a schematic cross-sectional view of a hydrocarbon well 10 that may include and/or utilize perforation devices 100 and/or methods 200, according to the present disclosure, to form one or more perforations 64 within downhole tubing 60. Downhole tubing 60 extends within a wellbore 50 that extends within a subterranean formation 40 and defines a downhole conduit 62. Downhole tubing 60 additionally or alternatively may be referred to herein as extending between a surface region 20 and the subterranean formation and/or as extending within a subsurface region 30. Subterranean formation 40 may include hydrocarbons 42.

As illustrated in FIG. 1, wellbore 50 may include a vertical, or an at least substantially vertical, region 56 and a horizontal, or deviated, region 58. Vertical region 56 may extend between surface region 20 and a heel 52 of the wellbore, and horizontal region 58 may extend between the heel and a toe 54 of the wellbore.

Perforation device 100 may be positioned within downhole conduit 62. This may include positioning the perforation device within vertical region 56 and/or within horizontal region 58 and may include flowing the perforation device from surface region 20 and/or from a wellhead 70 into the downhole conduit. When perforation device 100 is positioned within horizontal region 58, the perforation device may be conveyed through heel 52 to reach the horizontal region.

It is within the scope of the present disclosure that perforation device 100 may include and/or be an autonomous perforation device. Such an autonomous perforation device may be released within downhole conduit 62 and conveyed in a downhole direction 44, such as via flow of a conveyance fluid 48 through downhole conduit 62 and in downhole direction 44. Alternatively, it also is within the scope of the present disclosure that perforation device 100 may include and/or be an umbilical-attached perforation device that is attached to an umbilical 80. Umbilical 80, when present, may extend between wellhead 70 and perforation device 100, may be utilized to position the perforation device within the downhole conduit, and/or may be utilized to resist motion of the perforation device in downhole direction 44.

As illustrated in dashed lines in FIG. 1, hydrocarbon well 10 and/or perforation device 100 thereof also may include a gas supply structure 90. Gas supply structure 90, when present, may include a gas source 92 and/or may be configured to provide a gas stream 96 to perforation device 100, as discussed in more detail herein. Under these conditions, umbilical 80 may include and/or be a gas supply conduit 94 that may be configured to convey the gas stream to the perforation device and/or between the gas source and the perforation device.

Perforation device 100 may include an uphole end 102 and a downhole end 104. Perforation device 100 may define an elongate perforation device axis 106, which may extend between the uphole end and the downhole end. Uphole end 102 may face in uphole direction 46, while downhole end 104 may face in downhole direction 44. Perforation device 100 of FIG. 1 may include a plurality of additional structures, which are illustrated in FIGS. 2-8 and discussed in more detail herein with reference thereto. Stated another way, perforation device 100 of FIG. 1 may include and/or be any of the perforation devices that are illustrated in any of FIGS. 2-8 and discussed herein with reference thereto.

Figure 2:
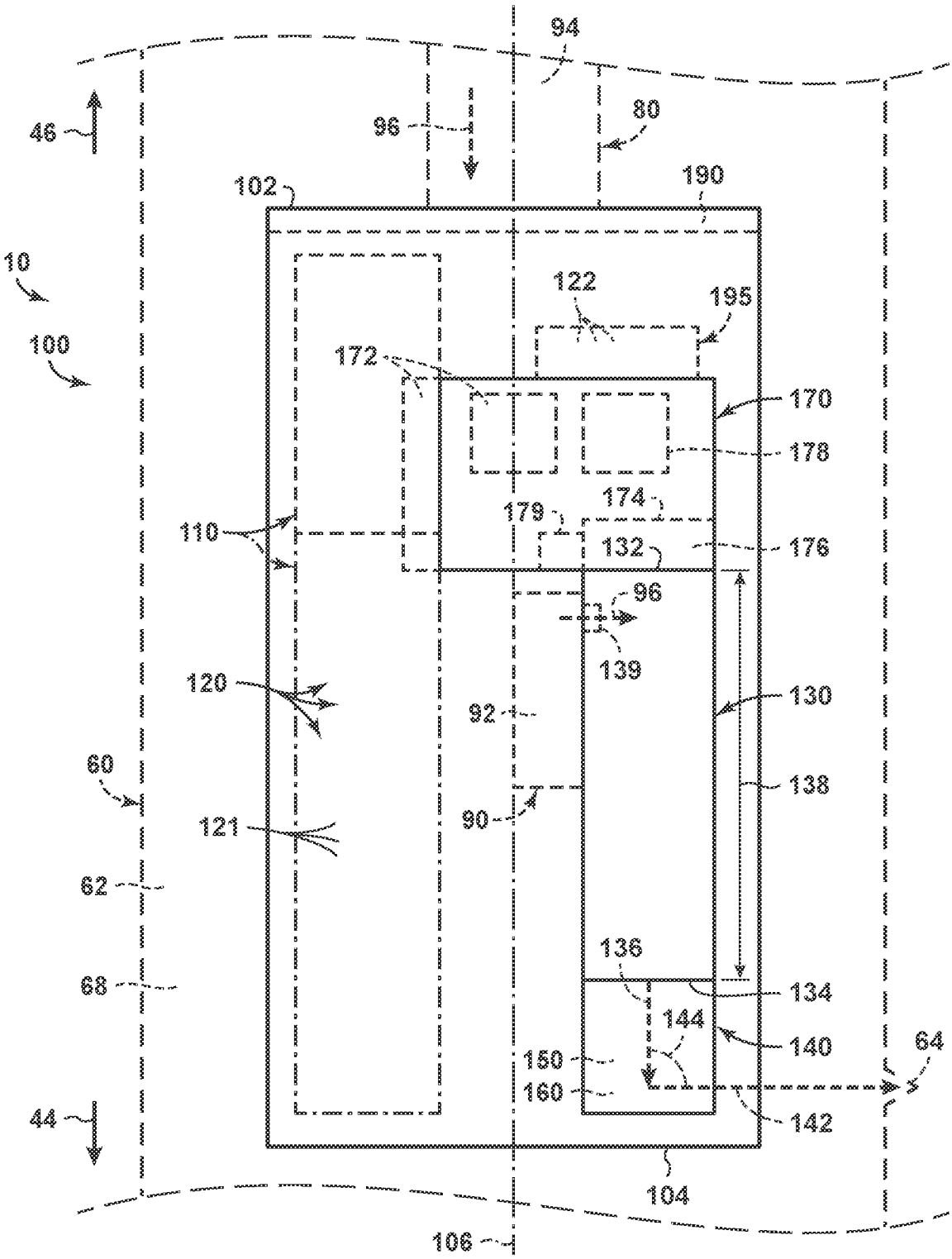
FIG. 2 is a schematic illustration of examples of perforation devices according to the present disclosure.

FIG. 2 is a schematic illustration of examples of perforation devices 100 according to the present disclosure, while FIGS. 3-8 are less schematic illustrations of examples of perforation devices 100 according to the present disclosure. FIGS. 3-8 may be more detailed and/or less schematic illustrations of perforation devices 100 that are illustrated in FIGS. 1-2. As such, any of the structures, functions, and/or features that are discussed herein with reference to perforation devices 100 of any one of FIGS. 1-8 may be included in and/or utilized with perforation devices 100 of any other of FIGS. 1-8 without departing from the scope of the present disclosure.

As illustrated in FIGS. 2-8, perforation devices 100 include a magazine 110 that is configured to house, contain, retain, and/or hold a plurality of cartridges 120. Perforation devices 100 also include a barrel 130 that extends between a breech 132 and a muzzle 134. Perforation devices 100 further include a trajectory-altering structure 140 and an action 170. Components of perforation devices 100, including at least magazine 110, barrel 130, trajectory-altering structure 140, and action 170 are operatively coupled to one another and are configured to move as a unit within a downhole conduit 62 that is defined by downhole tubing 60.

Figure 10:
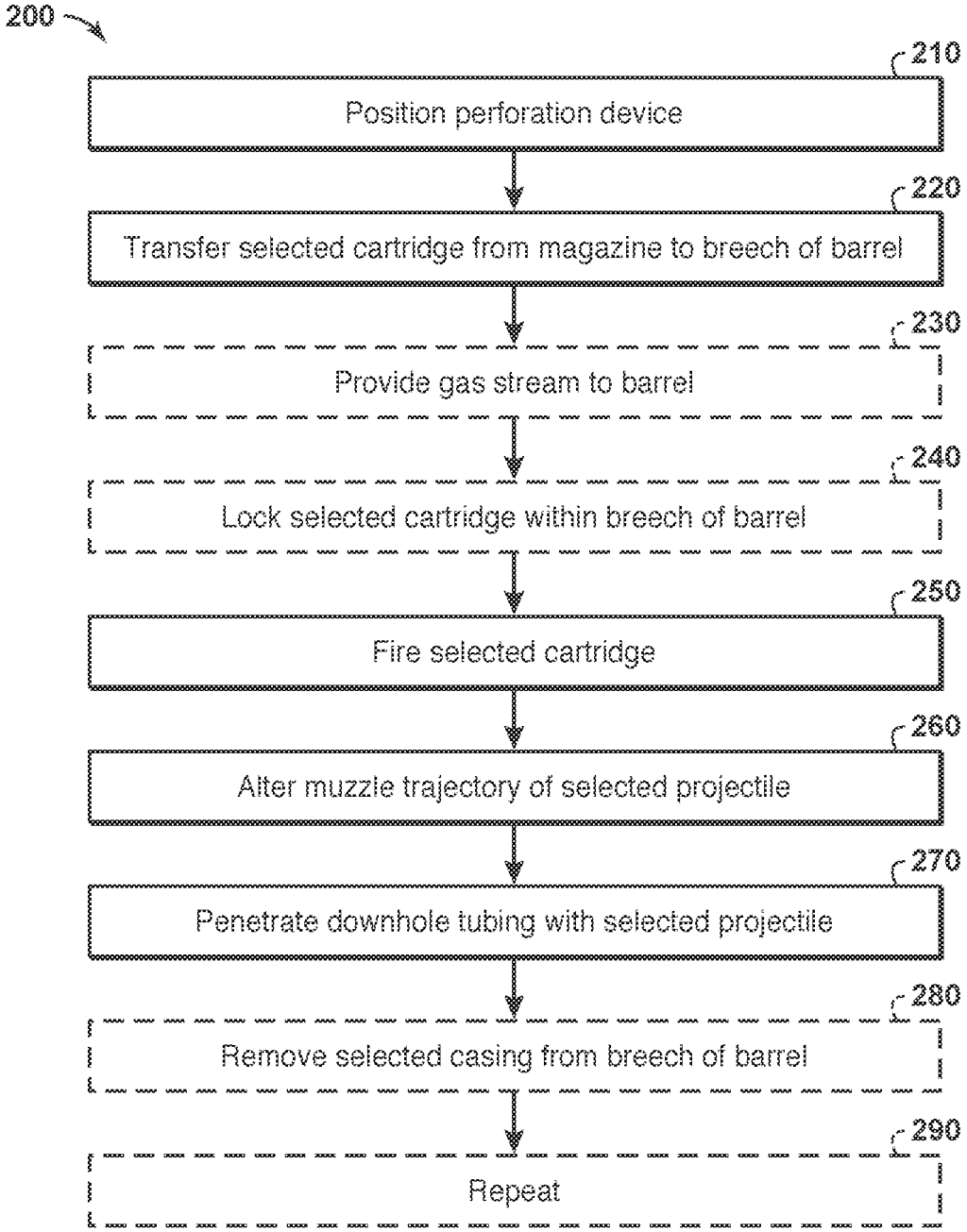
FIG. 10 is a flowchart depicting methods, according to the present disclosure, of perforating downhole tubing.

During operation of perforation devices 100, and as discussed in more detail herein with reference to methods 200 of FIG. 10, the perforation device may be positioned within downhole conduit 62. In addition, action 170 may be utilized to selectively and sequentially transfer a selected cartridge 120 from magazine 110 to breech 132 of barrel 130, and breech 132 may be configured to receive the selected cartridge from the magazine via the action. This is illustrated in dash-dot lines in FIGS. 3-8. As illustrated therein, action 170 may remove selected cartridge 120 from magazine 110, as indicated at 183, and may position the selected cartridge within breech 132 of barrel 130, as indicated at 184.

Subsequent to receipt of the cartridge within the breech of the barrel, action 170 may fire the selected cartridge. Firing the selected cartridge may accelerate a selected projectile 121 of the selected cartridge through barrel 130, as indicated in dash-dot lines in FIGS. 3-8 at 186. The selected projectile exits the barrel at a muzzle velocity and with a muzzle trajectory 136, and barrel 130 may be configured to permit the selected projectile to exit the muzzle of the barrel at the muzzle velocity and with the muzzle trajectory.

Responsive to firing of the selected cartridge, trajectory-altering structure 140 may receive the selected projectile and may act upon the selected projectile such that, upon exiting the trajectory-altering structure, the selected projectile defines a modified trajectory 142 that differs from the muzzle trajectory. Stated another way, trajectory-altering structure 140 may be configured to alter the trajectory of the selected projectile from muzzle trajectory 136 to modified trajectory 142. The modified trajectory may direct the selected projectile toward and/or into contact with downhole tubing 60, thereby causing the selected projectile to penetrate the downhole tubing and generate a perforation 64 within the downhole tubing. The selected projectile then may enter the subterranean formation, as indicated in dash-dot lines in FIGS. 3-8 at 187.

As illustrated in FIGS. 1-8, perforation device 100 may include and/or be an elongate perforation device that has, or defines, elongate perforation device axis 106. In addition, and as illustrated in FIGS. 2-8, muzzle trajectory 136 may be in downhole direction 44 and/or may be oriented along, or at least substantially along, the elongate perforation device axis. Stated another way, and when perforation device 100 is positioned within downhole conduit 62, muzzle trajectory 136 may be oriented along an elongate axis of downhole tubing 60 (such as tubing axis 66 that is illustrated in FIG. 1) and/or may define less than a threshold orientation angle with the elongate axis of the downhole tubing. Examples of the threshold orientation angle include threshold orientation angles of less than 25 degrees, less than 20 degrees, less than 15 degrees, less than 10 degrees, less than 5 degrees, less than 2.5 degrees, and/or less than 1 degree.

As discussed, modified trajectory 142 differs from muzzle trajectory 136. As an example, modified trajectory 142 and muzzle trajectory 136 may define a modification angle 144 therebetween. Examples of the modification angle include modification angles of at least 45 degrees, at least 50 degrees, at least 55 degrees, at least 60 degrees, at least 65 degrees, at least 70 degrees, at least 75 degrees, at least 80 degrees, at least 85 degrees, at least 90 degrees, at most 135 degrees, at most 130 degrees, at most 125 degrees, at most 120 degrees, at most 115 degrees, at most 110 degrees, at most 105 degrees, at most 100 degrees, at most 95 degrees, and/or at most 90 degrees.

As also discussed, modified trajectory 142 directs selected projectile 121 into contact with downhole tubing 60. Stated another way, modified trajectory 142 and downhole tubing 60 may define an angle of incidence therebetween. The angle of incidence may be measured between the modified trajectory and a direction that is normal to an inner surface of the downhole tubing at a point where the modified trajectory intersects the inner surface of the downhole tubing. An example of the angle of incidence includes angles of less than a ricochet angle, or less than a threshold ricochet angle, between the selected projectile and the downhole tubing. As used herein, the phrase "ricochet angle" may refer to an angle that is measured relative to a surface normal direction of a surface. When a projectile contacts the surface at an angle of incidence that is less than the ricochet angle, the projectile will penetrate the surface and/or will not ricochet from the surface. In contrast, when the projectile contacts the surface at an angle of incidence that is greater than the ricochet angle, the projectile will bounce off, or ricochet from, the surface. Additional examples of the angle of incidence include angles of at most 45 degrees, at most 40 degrees, at most 35 degrees, at most 30 degrees, at most 25 degrees, at most 20 degrees, at most 15 degrees, at most 10 degrees, at most 5 degrees, at most 2.5 degrees, at most 1 degree, and/or at least substantially zero degrees. The angle of incidence may be at least substantially equal to zero degrees in the illustration of FIG. 2.

Trajectory-altering structure 140 may include and/or be any suitable structure that may be adapted, configured, and/or shaped to modify the trajectory of selected projectile 121 from muzzle trajectory 136 to modified trajectory 142. In addition, trajectory-altering structure 140 may be incorporated into perforation device 100 in any suitable manner. As an example, trajectory-altering structure 100 may be operatively attached, directly operatively attached, and/or indirectly operatively attached to barrel 130.

As another example, trajectory-altering structure 140 and barrel 130 may define a unitary structure. As a more specific example, trajectory-altering structure 140 and barrel 130 may be formed and/or defined from a continuous length of material. The continuous length of material may include both a straight, or linear, region that defines barrel 130 and a curved, or bent, region that defines trajectory-altering structure 140. Under these conditions, muzzle 134 may be defined as a location, within the continuous length of material, wherein the continuous length of material transitions from the straight region to the curved region.

As yet another example, trajectory-altering structure 140 and barrel 130 may be spaced-apart from one another and/or may define a gap therebetween. Under these conditions, trajectory-altering structure 140 and barrel 130 both may be operatively attached to perforation device 100 and thus may be indirectly attached to one another via one or more other components of perforation device 100.

Figure 4:
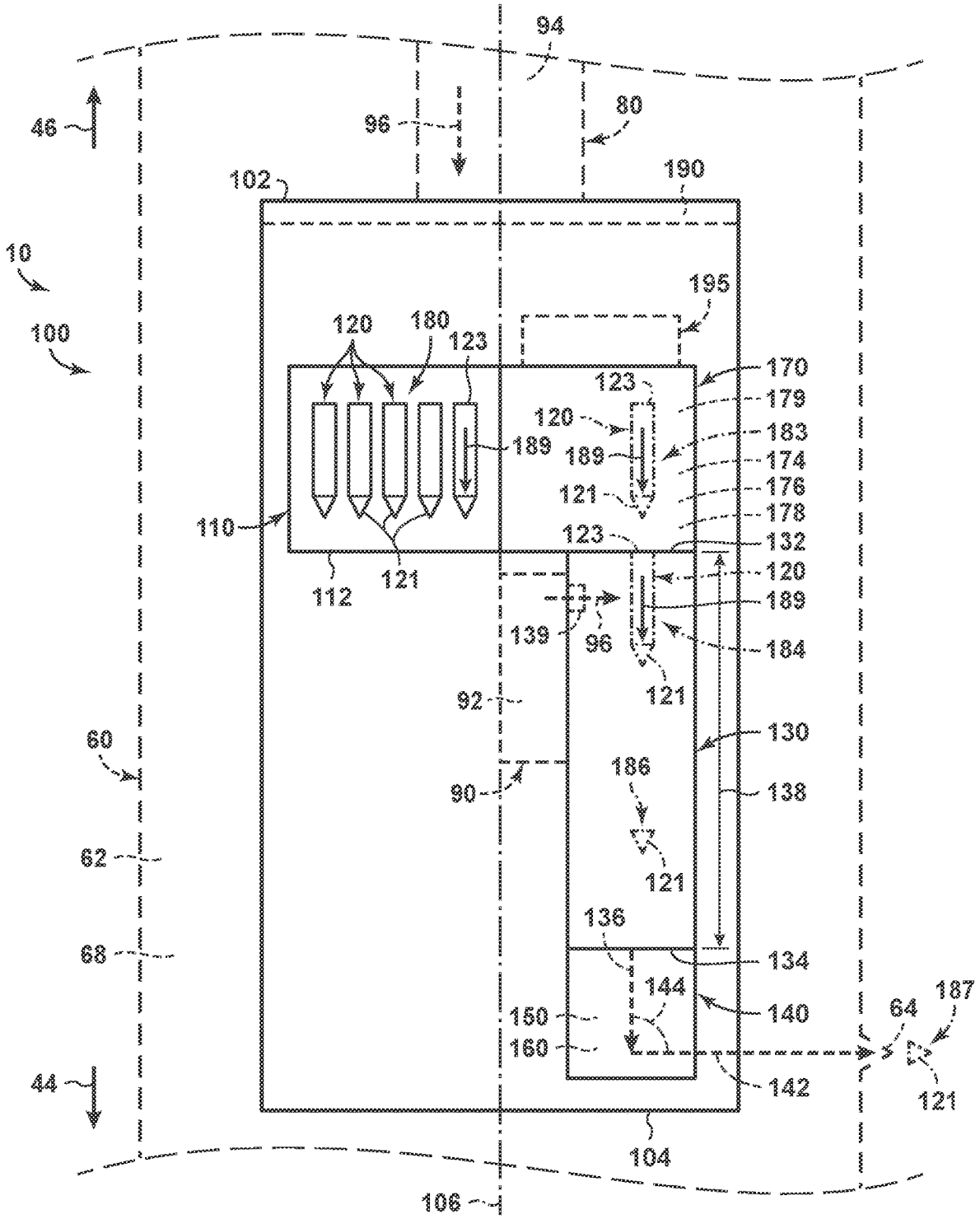
FIG. 4 is a less schematic illustration of examples of perforation devices according to the present disclosure.
Figure 5:
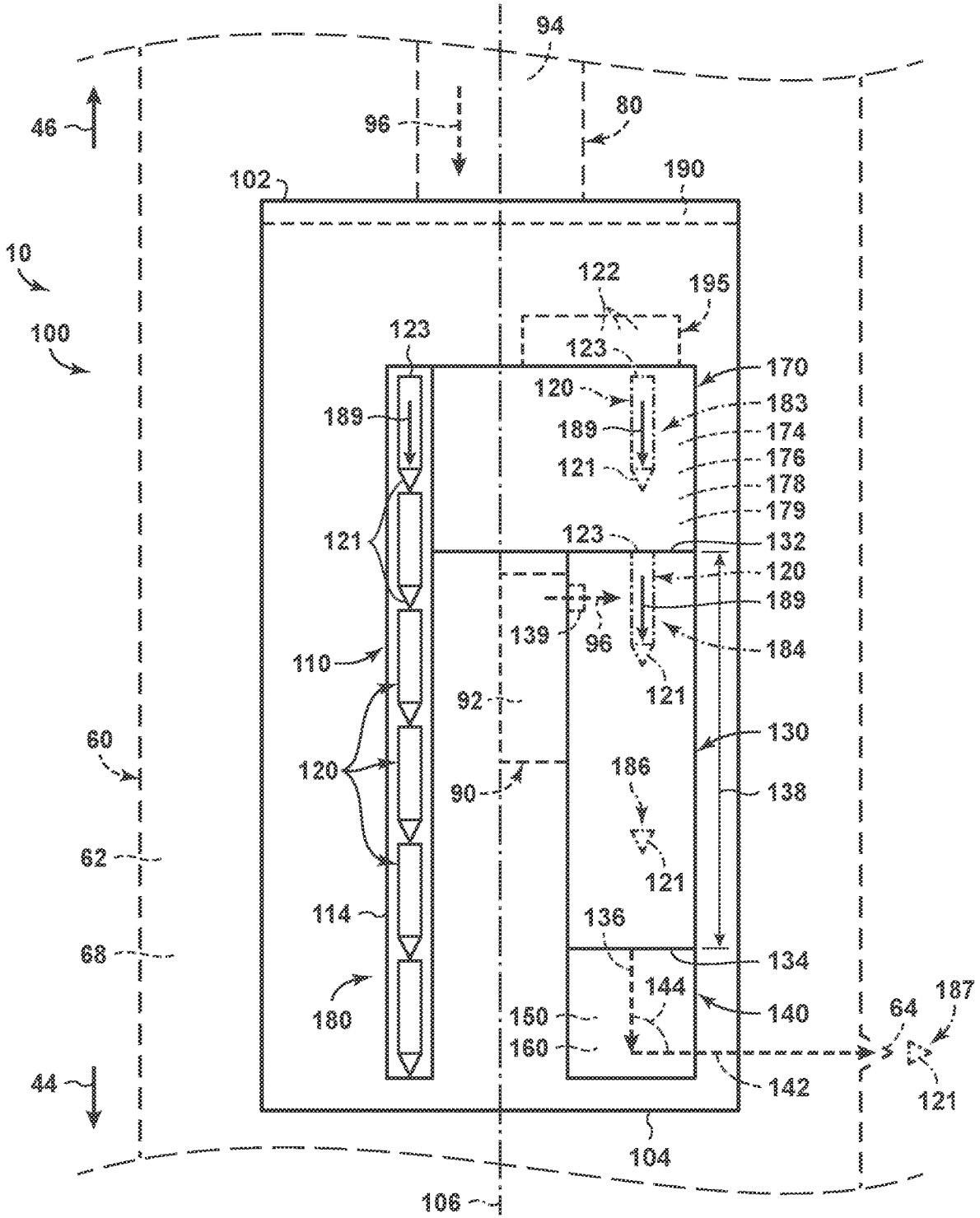
FIG. 5 is a less schematic illustration of examples of perforation devices according to the present disclosure.
Figure 6:
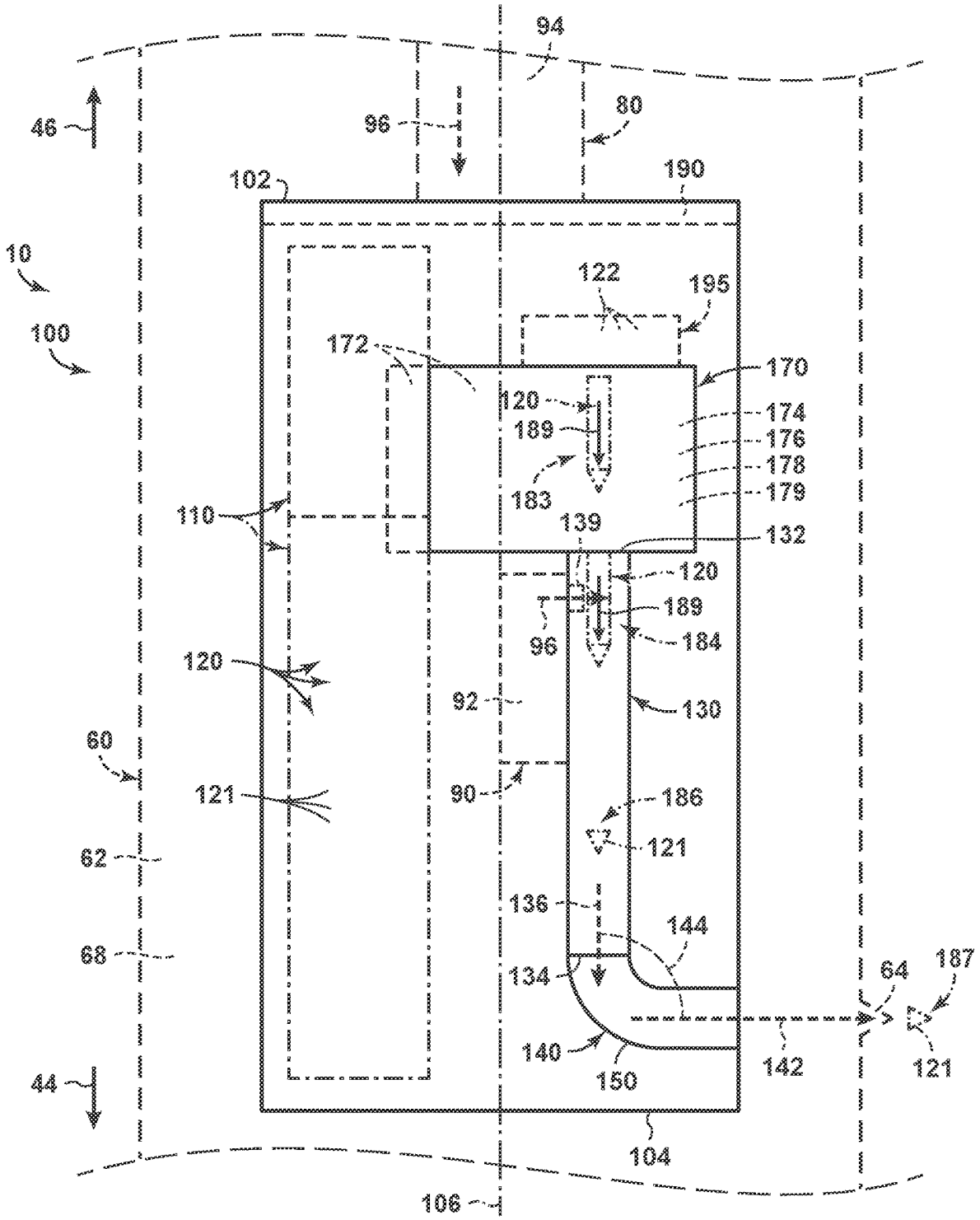
FIG. 6 is a less schematic illustration of examples of perforation devices according to the present disclosure.
Figure 8:
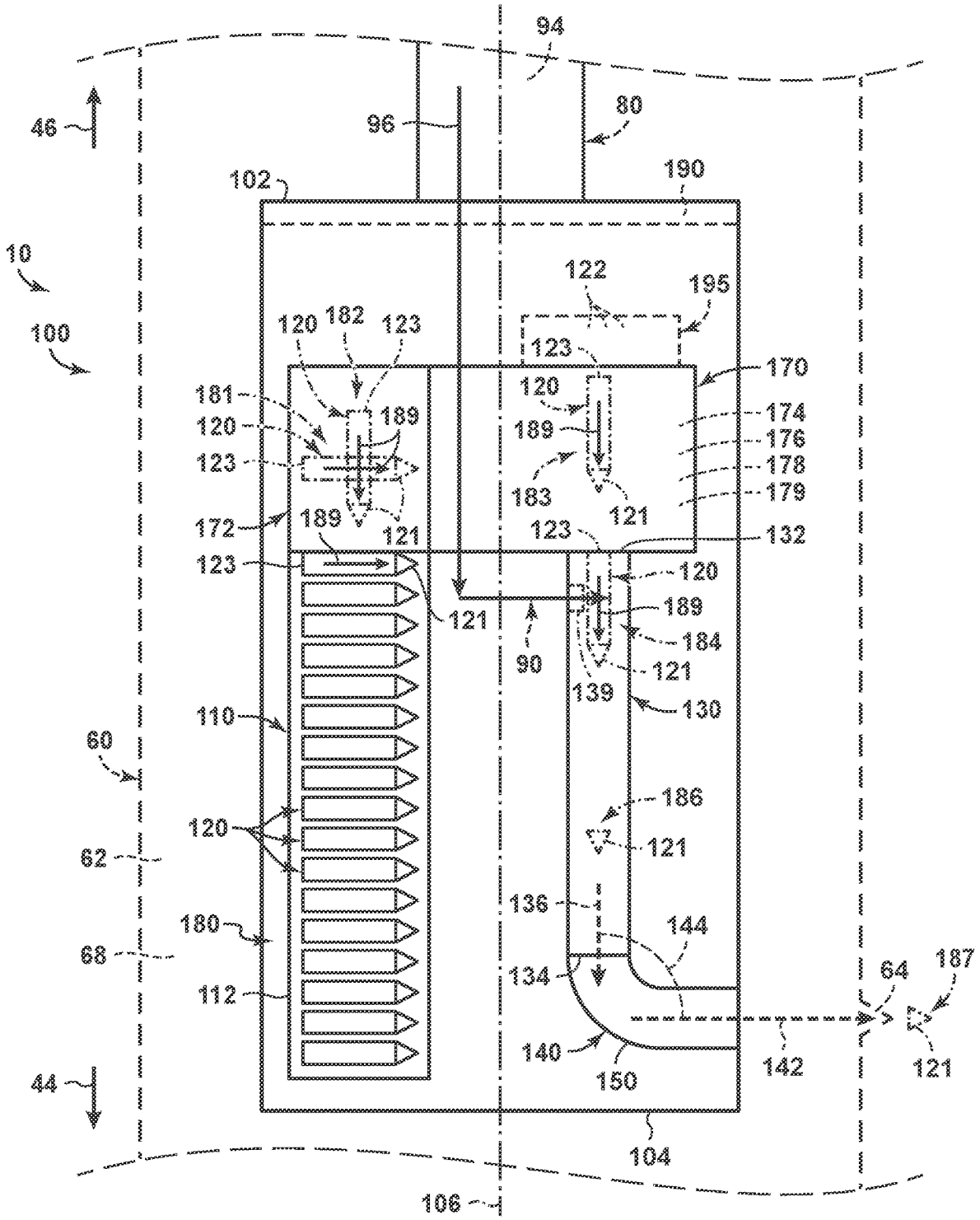
FIG. 8 is a less schematic illustration of examples of perforation devices according to the present disclosure.

An example of trajectory-altering structure 100 includes a bent tubular 150, examples of which are illustrated schematically in FIGS. 2-5 and less schematically in FIGS. 6 and 8. Bent tubular 150 may extend at least partially within muzzle trajectory 136, may extend from barrel 130, may be an extension of barrel 130, and/or may be a curved, non-linear, and/or arcuate region of barrel 130. Stated another way, bent tubular trajectory 150 may be (directly or indirectly) operatively attached to barrel 130 and/or may be defined by a unitary structure that includes barrel 130. When the selected projectile enters bent tubular 150, the selected projectile may follow the curved and/or arcuate shape of the bent tubular, thereby transitioning from the muzzle trajectory to the modified trajectory.

Bent tubular 150 may define an average structure transverse cross-sectional area and barrel 130 may define an average barrel transverse cross-sectional area. To facilitate modification of the selected projectile's trajectory from muzzle trajectory 136 to modified trajectory 142, the average barrel transverse cross-sectional area may be less than a threshold fraction of the average structure transverse cross-sectional area. Examples of the threshold fraction include threshold fractions of 90%, 80%, 70%, 60%, 50%, 40%, 30%, 20%, and/or 10%.

It is within the scope of the present disclosure that bent tubular 150 may be formed and/or defined by any suitable material and/or materials. As examples, bent tubular 150 may be formed and/or defined by one or more of a non-galling material, a ceramic material, a ceramic clad material, a material that is distinct from a material that defines barrel 130, the material that defines barrel 130, and/or a corrosion-resistant material. Such materials may be stable and/or non-reactive within subterranean formation 40 and/or may facilitate modification of the trajectory of the selected projectile without, or with less than a threshold amount of, damage to the selected projectile and/or to the trajectory-altering structure.

Figure 7:
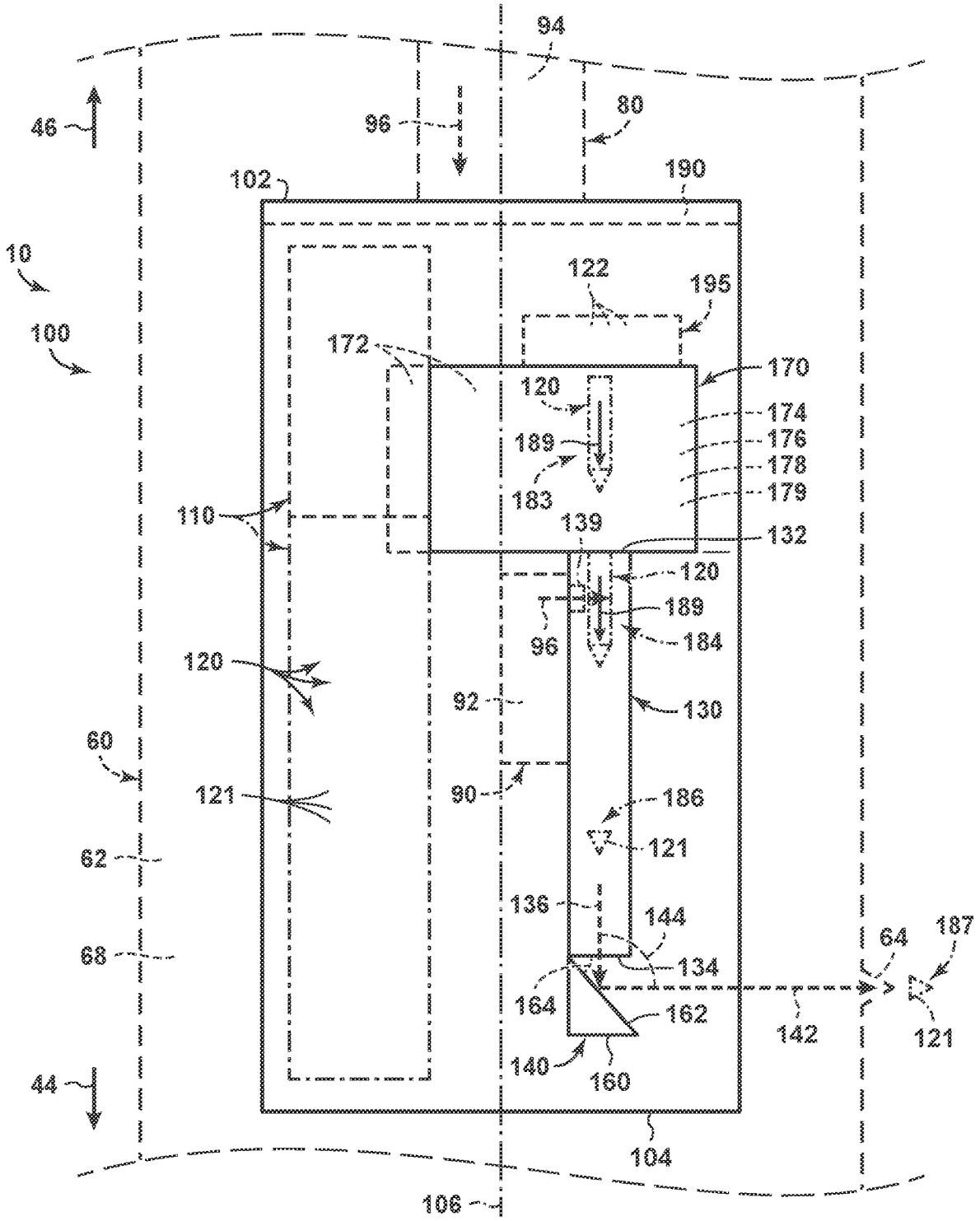
FIG. 7 is a less schematic illustration of examples of perforation devices according to the present disclosure.

Another example of trajectory-altering structure 100 includes a ricochet-inducing structure 160, examples of which are illustrated schematically in FIGS. 2-5 and less schematically in FIG. 7. As illustrated in FIG. 7, ricochet-inducing structure 160 may include a ricochet-inducing surface 162 that may be oriented at a ricochet-inducing surface angle 164 relative to muzzle trajectory 136. When the selected projectile contacts the ricochet-inducing surface, the selected projectile may ricochet from the ricochet-inducing surface, thereby transitioning from the muzzle trajectory to the modified trajectory. Examples of the ricochet-inducing surface angle include angles of at least 15 degrees, at least 20 degrees, at least 25 degrees, at least 30 degrees, at least 35 degrees, at least 40 degrees, at least 45 degrees, at most 75 degrees, at most 70 degrees, at most 65 degrees, at most 60 degrees, at most 55 degrees, at most 50 degrees, and/or at most 45 degrees.

Figure 3:
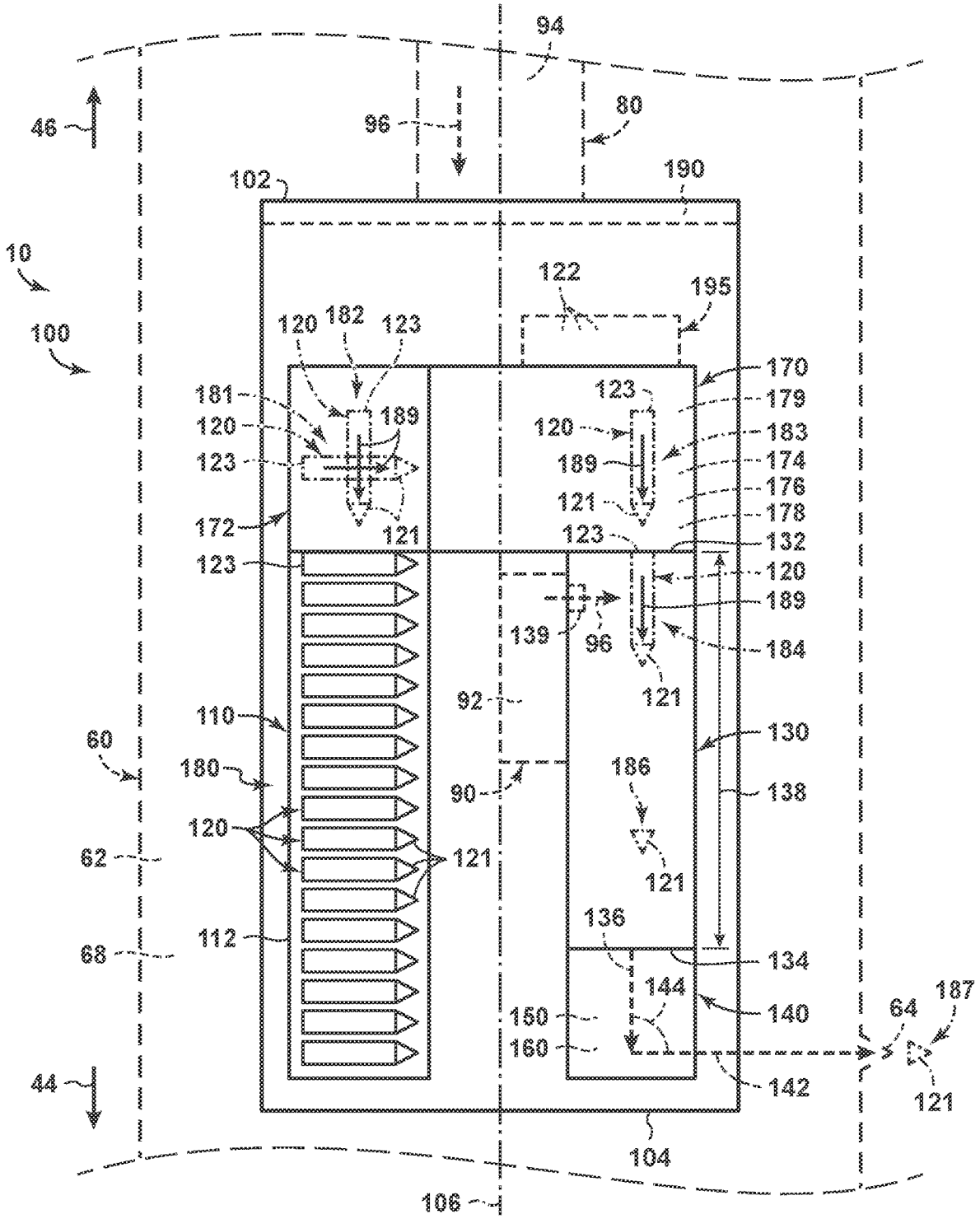
FIG. 3 is a less schematic illustration of examples of perforation devices according to the present disclosure.

Magazine 110 may include any suitable structure that may be configured to store, house, and/or contain the plurality of cartridges 120. Examples of magazine 110 include a stack magazine 112, as illustrated in FIGS. 3-4 and 8, and/or a tubular magazine 114, as illustrated in FIG. 5. The examples of magazines 110 in FIGS. 3-5 and 8 are not exclusive and are not limited to the particular examples of perforation devices 100, or other components thereof, shown in these figures. As illustrated schematically in dash-dot lines in FIGS. 2-3 and 5-8, magazine 110 may extend at least partially, or even completely, along a length of barrel 130. Stated another way, magazine 110 may extend at least partially, or even completely, between breech 132 and muzzle 134 of barrel 130. Such a configuration may facilitate a decrease in an overall size and/or length of perforation device 100, as projectiles 120 may be stored at least partially within a portion of a length of the perforation device that also includes the barrel. Additionally or alternatively, and as illustrated in dashed lines in FIGS. 2 and 6-7 and in solid lines in FIG. 4, magazine 110 may extend away from both breech 132 and muzzle 134 of barrel 130.

It is within the scope of the present disclosure that the plurality of cartridges 120 may include any suitable number of cartridges. As examples, the plurality of cartridges may include at least 50, at least 100, at least 200, at least 300, at least 400, at least 500, at most 1000, at most 800, and/or at most 600 cartridges. Inclusion of such a large number of cartridges 120 within magazine 110 may permit a corresponding number of perforations 64 to be formed within downhole tubing 60 without a need to remove perforation device 100 from downhole conduit 62 and/or without a need to reload magazine 110. It also is within the scope of the present disclosure that perforation device 100 may include a plurality of magazines 110. Under these conditions, each magazine 110 in the plurality of magazines 110 may include any suitable number of cartridges 120, examples of which are disclosed herein.

As illustrated in FIGS. 3-5 and 8, selected cartridge 120 may have and/or define a projectile direction 189, which may extend from a head 123 of the selected cartridge toward projectile 121 of the selected cartridge (e.g., the selected projectile). It is within the scope of the present disclosure that cartridges 120 may have any suitable projectile direction while contained within magazine 110 and/or prior to being transferred from the magazine to the breech of the barrel. It also is within the scope of the present disclosure that projectile direction 189 may vary in any suitable manner as the selected cartridge is transferred from the magazine to the breech of the barrel.

As an example, and as illustrated in FIGS. 4-5, projectile direction 189 of the selected cartridge while the selected cartridge is within the magazine, which is indicated at 180, may be parallel, or at least substantially parallel, to the projectile direction of the selected cartridge while the selected cartridge is within the breech of the barrel, which is indicated at 183. Stated another way, the projectile direction of the selected cartridge, while the selected cartridge is contained within the magazine, may be parallel, or at least substantially parallel, to muzzle trajectory 136.

As another example, and as illustrated in FIGS. 3 and 8, projectile direction 189 may be perpendicular, or at least substantially perpendicular, to muzzle trajectory 136 while the selected projectile is contained within magazine 110 and/or prior to the selected cartridge being transferred from the magazine to the breech of the barrel, as indicated at 180. As illustrated, such a configuration may permit and/or facilitate storage of a relatively large number of cartridges within magazine 110 without the need to increase, or significantly increase, an overall size, length, and/or transverse cross-sectional area of perforation device 100.

Under these conditions, perforation device 100 may include a cartridge rotating structure 172. Cartridge rotating structure 172 may form a portion of magazine 110, may form a portion of action 170, and/or may be a distinct structure of perforation device 100. When present, cartridge-rotating structure 172 may be configured to receive selected cartridge 120, as indicated at 181, and to rotate the selected cartridge such that projectile direction 189 is parallel, or at least substantially parallel, to muzzle trajectory 136, as indicated at 182. The selected projectile then may be transferred to breech 132 of barrel 130, as indicated at 183 and 184.

Barrel 130 may include any suitable structure that may define breech 132 and muzzle 134, that may extend between the breech and the muzzle, and/or that may be configured to permit the selected projectile to exit the muzzle at the muzzle velocity and/or with the muzzle trajectory. In addition, a single, or only one, barrel 130 may be configured to receive and to fire each cartridge 120 in the plurality of cartridges. Stated another way, barrel 130 may be configured to sequentially receive each cartridge in the plurality of cartridges, to fire each cartridge in the plurality of cartridges, and/or to permit each projectile of each cartridge in the plurality of cartridges to exit the barrel via muzzle 134.

Barrel 130 may have and/or define a barrel length 138, as illustrated in FIG. 2, which may be measured between breech 132 and muzzle 134. The barrel length may be selected to provide a desired, or a target, muzzle velocity for the selected projectile upon exiting the muzzle of the barrel. The orientation of barrel 130 within perforation device 100 such that muzzle trajectory 136 is parallel, or at least substantially parallel, to tubing axis 66 may permit perforation device 100 to include longer barrels 130, which may produce correspondingly higher muzzle velocities, when compared to a barrel that defines a muzzle trajectory that is directed perpendicular, or at least substantially perpendicular, to the tubing axis. Barrel 130 also may be a rifled barrel, which further may increase muzzle velocity and/or penetration of projectiles 121 that may be fired therethrough.

Barrel 130 may be formed and/or defined from any suitable material and/or materials. As examples, barrel 130 may be formed from one or more of a corrosion-resistant material, steel, and stainless steel.

As illustrated in dashed lines in FIGS. 1-7, hydrocarbon well 10 and/or perforation device 100 that is utilized therein further may include, may be associated with, and/or may be in fluid communication with a gas supply structure 90. Gas supply structure 90, when present, may be configured to provide a gas stream 96 to barrel 130, as illustrated in FIGS. 2-8. When perforation device 100 is positioned within downhole conduit 62, supply of gas stream 96 to barrel 130 may restrict and/or block flow of a wellbore fluid 68, which may extend within downhole conduit 62, into barrel 130. Stated another way, supply of the gas stream to the barrel may maintain a gaseous environment within barrel 130 and/or between the breech and the muzzle of the barrel. Such a configuration may increase the muzzle velocity of projectiles fired from barrel 130 relative to a muzzle velocity that would be obtainable if a liquid wellbore fluid was allowed to flow into the barrel from the downhole conduit.

It is within the scope of the present disclosure that gas supply structure 90 may provide gas stream 96 to barrel 130 in any suitable manner. As an example, the gas supply structure may provide the gas stream to the breech of the barrel. As another example, the barrel may include a gas injection port 139, and the gas supply structure may provide the gas stream to the gas injection port.

Gas supply structure 90 may supply gas stream 96 in any suitable manner. As an example, and as illustrated in FIGS. 2-7, gas source 92 may include and/or be a downhole gas source 92 that may be positioned within the wellbore and/or within perforation device 100.

As another example, gas supply structure 90 may include and/or may be in fluid communication with a gas source 92 that may be configured to generate and/or to supply the gas stream. Gas source 92, when present, may include and/or be a surface gas source that is positioned within surface region 20, as illustrated in FIG. 1. Such a surface gas source may provide the gas stream to the barrel via a gas supply conduit 94 that may be defined by an umbilical 80, as illustrated in FIGS. 1-8. An example of the gas supply conduit includes coiled tubing.

Gas stream 96 may include and/or be any suitable gas stream that may be provided to barrel 130. As examples, gas stream 96 may include one or more of a nitrogen stream, a carbon dioxide stream, an inert gas stream, a gaseous hydrocarbon stream, and/or an air stream.

Figure 9:
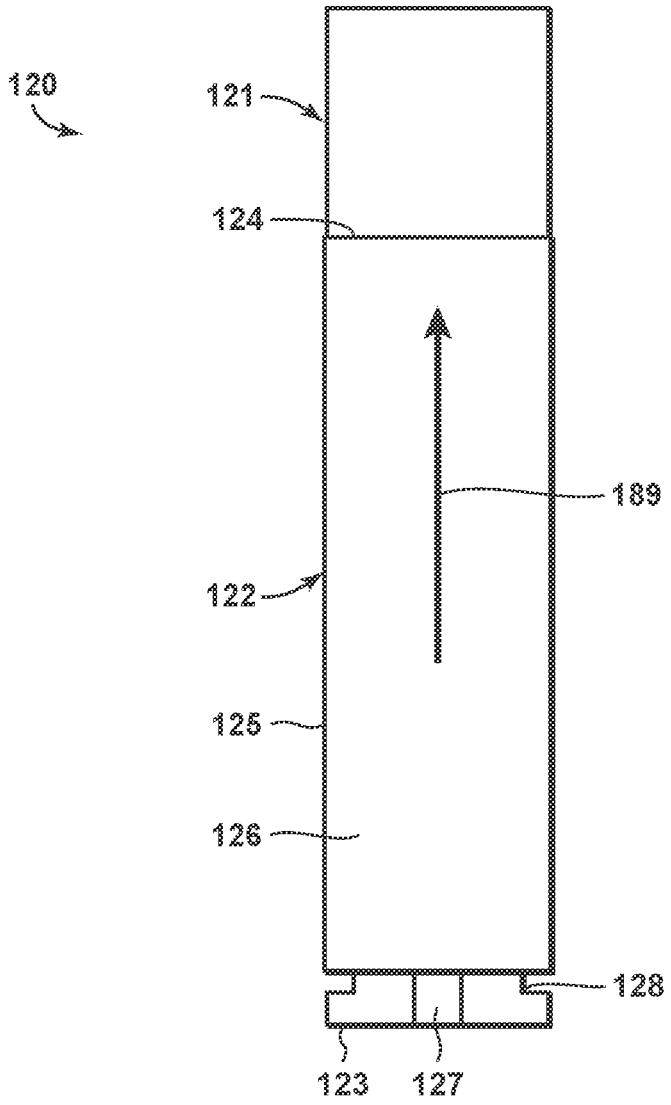
FIG. 9 is a schematic representation of a cartridge that may be included in and/or utilized with perforation devices and/or methods, according to the present disclosure.

As illustrated in FIG. 9 and discussed in more detail herein with reference thereto, cartridges 120 that may be utilized within and/or that may form a portion of perforation devices 100 may include a casing 122. Casing 122, when present, may remain within breech 132 of barrel 130 subsequent to firing of projectile 121. Under these conditions, and as also discussed in more detail herein, action 170 may be configured to remove the casing from the breech of the barrel, such as to permit a subsequent cartridge to be positioned within the breech of the barrel, and perforation device 100 may include a casing collector 195. Casing collector 195, when present, may be configured to retain a plurality of casings, or spent casings, that remain after firing the plurality of projectiles. Stated another way, casing collector 195 may collect and/or retain casings 122, thereby retaining the casings within perforation device 100 and/or preventing the casings from accumulating within downhole conduit 62.

As illustrated in dashed lines in FIGS. 2-8, perforation devices 100 also may include a rotation structure 190. Rotation structure 190, when present, may be configured to selectively rotate at least trajectory-altering structure 140 of perforation device 100 within downhole conduit 62. This selective rotation may permit and/or facilitate formation of a plurality of perforations within downhole tubing 60 that has and/or defines a desired angular perforation distribution. Stated another way, rotation structure 190 may be utilized to rotate at least trajectory-altering structure 140, such as about elongate perforation device axis 106, thereby permitting formation of perforations 64 within downhole tubing 60 at a variety of different, or desired, angular orientations with respect to the elongate perforation device axis (e.g., with respect to the circumferential orientation when the wellbore is viewed along its central throughbore axis in cross-section). Stated yet another way, rotation structure 190 may be configured to selectively vary an orientation of modified trajectory 142 relative to downhole tubing 60. Thereby, fracture initiation may be during hydraulic fracturing may be oriented in an orientation favorable to the subsurface stress orientations.

Another advantage of the presently disclosed technology is the ability to create a perforation through the well casing wall that does not penetrate deeply into the subsurface formation. For hydraulic fracturing, it may sometimes be unnecessary or undesired to penetrate deeply into a subsurface formation, such as is often affected with a shaped charge, creating what is sometimes referred to as a perforation tunnel. It is known that at some point near or subsequent to the end of a hydraulic fracture treatment that it is often desirable for hydraulic pressure within the subsurface perforation to be relaxed so the formation may "close" on the proppant pack to prevent the proppant from flowing back into the wellbore. In some instances or formation types, a shape-charge created perforation tunnel may experience some difficulty closing at or near the wellbore perforation due to destruction of subsurface formation strata by the shape-charge jet. That is, the perforation tunnel may have difficulty applying sufficient closure stress upon the proppant pack in the perforation tunnel, resulting in flow-back of an undesirable amount of proppant. The presently disclosed perforating technology may alleviate this potential deficiency.

The presently disclosed perforating technology provides a projectile that may provide a perforation of a determined, known diameter, through a casing wall of known properties, such that the projectile only passes beyond the casing wall for a short or limited penetration distance of the subsurface formation. In many instances, a hydraulically induced fracture for a fracture stimulation may be initiated into the subsurface formation at the wellbore casing, without need for a lengthy perforation tunnel. In some hydraulic fracture stimulations, it may be desirable for the created perforation to retain as much subsurface formation material in proximity to the casing wall, by providing only a relatively "short" perforation tunnel as compared to a shape-charge-created perforation tunnel. Thereby, closure of the hydraulic fracture upon the proppant pack in close proximity to the wellbore perforation, as may be facilitated by the present technology may provide for improved closure stress performance upon the proppant pack and reduced proppant flow-back, as compared to shape-charge created perforation tunnels.

Still another benefit of the present technology is that the projectile may provide a perforation that includes with a very circular or circumferentially round perimeter that exhibits work hardening of the steel in the immediate vicinity of the perforation aperture. Extrusion of portions of the steel from the casing may also extend toward the exterior side of the casing wall, so as to provide a bit of a frusto-conical, funnel, or hyperbolic horn-bell shaped aperture to the perforation, as opposed to the melted or burred extrusion created by the heat from a shaped-charge. Similar perforation shapes may be observed in metal signs having bullet holes therein. The perforation shape properties and work-hardening of the steel within the perforation that may be created the present technology may provide improved predictability for hydraulic performance and analysis through the perforation, proppant erosion resistance, and a more desirable and known perforation shape for seating a ball sealer thereon so as to affect reduced ball sealer leakage and improved hydraulic isolation of the perforation during treatment of other stages or perforations, as compared to such performance as provided by a shaped charge. Thereby, the present technology may afford numerous advantages in some applications as compared to jet perforating.

It is within the scope of the present disclosure that perforation device 100 may have and/or define any suitable length, which may be measured along elongate perforation device axis 106, and/or maximum transverse cross-sectional dimension, which may be measured perpendicular to the elongate perforation device axis. Examples of the length of perforation device 100 include lengths of at least 25 centimeters, at least 50 centimeters, at least 75 centimeters, at least 100 centimeters, at least 150 centimeters, at least 200 centimeters, at least 250 centimeters, at least 300 centimeters, at least 400 centimeters, at least 500 centimeters, at most 1000 centimeters, at most 750 centimeters, at most 500 centimeters, and/or at most 250 centimeters Examples of the maximum transverse cross-sectional extent include extents of less than 20 centimeters, less than 18 centimeters, less than 16 centimeters, less than 14 centimeters, less than 12 centimeters, less than 10 centimeters, less than 8 centimeters, less than 6 centimeters, and/or less than 4 centimeters.

Action 170 may include any suitable structure that may be adapted, configured, designed, and/or constructed to transfer cartridges 120 from magazine 110 to breech 132 of barrel 130 and/or to fire cartridges 120. As an example, action 170 may include one or more conventional structures of conventional firearm actions. As a more specific example, action 170 may include a bolt 174. Bolt 174, when present, may be configured to selectively and sequentially urge cartridges 120, or the selected cartridge 120, from magazine 110 and toward and/or into breech 132 of barrel 130.

As another more specific example, action 170 may include a lock mechanism 176. Lock mechanism 176, when present, may be configured to selectively and sequentially lock cartridges 120, or the selected cartridge 120, within breech 132. Lock mechanism 172 also may be referred to herein as a securing mechanism and/or as a retention mechanism that may be configured to secure and/or retain cartridges 120 within breech 132.

As yet another more specific example, action 170 may include a firing mechanism 178. Firing mechanism 178, when present, may be configured to selectively and sequentially fire cartridges 120, or the selected cartridge 120, subsequent to cartridges 120 being positioned within breech 132 and/or locked within breech 132. Examples of firing mechanism 178 and/or of components thereof include a firing pin, a hammer, and/or a trigger assembly.

As another more specific example, action 170 may include an extractor 179. Extractor 179, when present, may be configured to selectively and sequentially extract cartridges 120, or casings 122 of cartridges 120, from breech 132. As an example, and as illustrated in FIG. 9 and discussed in more detail herein with reference thereto, cartridges 120 may include an extractor groove 128, and extractor 179 may be configured to operatively engage the extractor groove to extract cartridges 120 from breech 132.

As discussed, action 170 may be configured to selectively fire cartridges 120, and it is within the scope of the present disclosure that the action may fire the cartridges responsive to and/or based upon any suitable criteria. As an example, action 170 may be configured to fire cartridges 120, or to fire a given cartridge 120, responsive to receipt of a firing signal. Examples of the firing signal include an electronic firing signal, a mechanical firing signal, a wireless firing signal, a predetermined pressure pulse sequence within the wellbore fluid, and/or a predetermined mechanical force sequence applied to the perforation device by umbilical 80.

Cartridges 120 may include any suitable structure that may be contained within magazine 110, that may include projectiles 121, and/or that may be selectively fired by action 170. This may include conventional cartridges 120 that may be fired from conventional firearms (i.e., a firearm cartridge) and/or specialized cartridges 120 that may be specially designed and/or constructed to be utilized within perforation devices 100.

FIG. 9 is a schematic representation of a cartridge 120 that may be included in and/or utilized with perforation devices 100 and/or methods 200, according to the present disclosure. Cartridges 120 illustrated in the example of FIG. 9 include a casing 122 that defines a head 123, a mouth 124, and a body 125 that extends between the head and the mouth. Cartridges 120 also include a projectile 121, which may be positioned within mouth 124, a propellant 126, which may be contained within body 125 and/or within a volume that is at least partially defined by body 125, an igniter 127, and/or an extractor groove 128.

Igniter 127 may include any suitable structure and/or composition that may be utilized to ignite propellant 126. Examples of igniter 127 include any suitable primer, or conventional primer, electronic ignition structure, and/or chemical ignition structure.

Propellant 126 may include any suitable structure and/or composition that may be ignited by igniter 127 and/or that may accelerate projectile 121 subsequent to being ignited by igniter 127. Examples of propellant 126 include a charge of powder, a charge of gunpowder, and/or a charge of smokeless powder.

Casing 122 may include any suitable structure that may contain propellant 126 and/or that may operatively interconnect, may be operatively attached to, and/or may include projectile 121 and igniter 127. Examples of casing 122 include a metallic casing, a brass casing, a steel casing, a biodegradable casing, and/or a casing that is configured to corrode within the wellbore and/or within the wellbore fluid.

Projectile 121 may include any suitable structure that may be accelerated from barrel 130, such as via ignition of propellant 126. This may include any suitable conventional projectile that may be configured to be utilized in a conventional firearm and/or any suitable specialized projectile that may be specially configured to be utilized within perforation devices 100. Examples of projectile 121 include a metallic projectile, an armor-piercing projectile, an explosive projectile, a bi-metallic projectile, a tank-penetrating projectile, and/or a sabot-encased projectile.

FIG. 10 is a flowchart depicting methods 200, according to the present disclosure, of perforating downhole tubing. The downhole tubing may define a downhole conduit and may extend within a wellbore that extends within a subterranean formation. Methods 200 include positioning the perforation device at 210 and transferring a selected cartridge from a magazine to a breech of a barrel at 220. Methods 200 may include providing a gas stream to the barrel at 230 and/or locking the selected cartridge within the breech of the barrel at 240, and methods 200 include firing the selected cartridge at 250. Methods 200 also include altering a muzzle trajectory of a selected projectile at 260 and penetrating downhole tubing with the selected projectile at 270, and methods 200 may include removing a selected casing from the breech of the barrel at 280 and/or repeating at least a portion of the methods at 290.

Positioning the perforation device at 210 may include positioning the perforation device within the downhole conduit. This may include flowing the perforation device from a surface region and/or in a downhole direction within the downhole conduit. The flowing may include flowing the magazine, the barrel, and a trajectory-altering structure of the perforation device as a unit, or as an assembly, within the downhole conduit. Stated another way, at least the magazine, the barrel, and the trajectory-altering structure may be operatively linked to one another and/or may be configured to move as a unit, or as an assembly, within the downhole conduit. Examples of the perforation device are disclosed herein with reference to perforation device 100 of FIGS. 2-8. Examples of the barrel are disclosed herein with reference to barrel 130 of FIGS. 2-8. Examples of the magazine are disclosed herein with reference to magazine 110 of FIGS. 2-8. Examples of the trajectory-altering structure are disclosed herein with reference to trajectory-altering structure 140 of FIGS. 2-8.

Transferring the selected cartridge from the magazine to the breech of the barrel at 220 may include selectively transferring the selected cartridge, or a plurality of cartridges contained within the magazine, in any suitable manner. As an example, the transferring at 220 may include transferring the selected cartridge with, via, and/or utilizing an action of the perforation device. Examples of the action are disclosed herein with reference to action 170 of FIGS. 2-8.

Providing the gas stream to the barrel at 230 may include providing any suitable gas stream to the barrel in any suitable manner. As an example, the providing at 230 may include providing the gas stream with, via, and/or utilizing a gas supply structure that may include a gas source. The gas source may include and/or be a downhole gas source. Additionally or alternatively, the gas source may include and/or be a surface gas source. Under these conditions, the providing at 230 also may include conveying the gas stream from the surface gas source to the barrel with, via, and/or utilizing a gas supply conduit, such as coiled tubing. Examples of the gas supply structure are disclosed herein with reference to gas supply structure 90 of FIGS. 1-8.

Locking the selected cartridge within the breech of the barrel at 240 may include selectively locking, securing, and/or retaining the selected cartridge within the breech of the barrel, such as with a lock mechanism of the perforation device and/or of the action. The locking at 240 may be performed subsequent to the transferring at 220 and prior to the firing at 250.

Firing the selected cartridge at 250 may include selectively firing the selected cartridge to accelerate the selected projectile of the selected cartridge from a muzzle of the barrel at a muzzle velocity and with a muzzle trajectory. The firing at 250 may be accomplished in any suitable manner. As an example, and as discussed herein with reference to FIGS. 2-8, the action may include a firing mechanism that may be actuated to fire the selected cartridge. As another example, and as discussed herein with reference to FIG. 9, the selected cartridge may include an igniter and a propellant, and the firing at 250 may include actuating the igniter to ignite the propellant and accelerate the selected projectile from the muzzle of the barrel. The firing at 250 may be performed subsequent to the positioning at 210, subsequent to the transferring at 220, subsequent to the providing at 230, subsequent to the locking at 240, prior to the altering at 260, prior to the penetrating at 270, and/or prior to the removing at 280.

Altering the muzzle trajectory of the selected projectile at 260 may include the muzzle trajectory of the selected projectile with the trajectory-altering structure. This may include altering the muzzle trajectory such that, upon exiting the trajectory-altering structure, the selected projectile has a modified trajectory that differs from the muzzle trajectory. Examples of the muzzle trajectory, the modified trajectory, and/or of modification angles between the muzzle trajectory and the modified trajectory are disclosed herein with reference to muzzle trajectory 136, modified trajectory 142, and modification angle 144, respectively, of FIGS. 2-8.

The altering at 260 may include altering with any suitable trajectory-altering structure. This may include altering with a bent tubular trajectory-altering structure, such as by conveying the selected projectile through the bent tubular. Additionally or alternatively, the altering at 260 also may include altering with a ricochet-inducing structure, such as by ricocheting the selected projectile off the ricochet-inducing structure and/or off a ricochet-inducing surface of the ricochet-inducing structure. The altering at 260 may be performed subsequent to the positioning at 210, subsequent to the transferring at 220, subsequent to the providing at 230, subsequent to the locking at 240, subsequent to the firing at 250, responsive to the firing at 250, prior to the penetrating at 270, and/or prior to the removing at 280.

Penetrating downhole tubing with the selected projectile at 270 may include penetrating the downhole tubing to form and/or define a perforation within the downhole tubing. The perforation may provide fluid communication between the downhole conduit and the subterranean formation. The penetrating at 270 may be performed subsequent to the positioning at 210, subsequent to the transferring at 220, subsequent to the providing at 230, subsequent to the locking at 240, subsequent to the firing at 250, responsive to the firing at 250, subsequent to the altering at 260, and/or prior to the removing at 280.

Removing the selected casing from the breech of the barrel at 280 may include spatially separating the selected casing and the barrel. This may include removing to permit and/or facilitate the repeating at 290. The removing at 280 may be performed subsequent to the positioning at 210, subsequent to the transferring at 220, subsequent to the providing at 230, subsequent to the locking at 240, subsequent to the firing at 250, and/or responsive to the firing at 250.

Repeating at least a portion of the methods at 290 may include repeating any suitable portion of methods 200 in any suitable order. As an example, the perforation may be a first perforation, and the repeating at 290 may include repeating to form and/or define a second, or a subsequent, perforation within the downhole tubing. This may include repeating at least the positioning, the transferring, the firing, the altering, and the penetrating a plurality of times to form a plurality of perforations within the downhole tubing. The repeating the positioning may include moving the perforation device along the length of the downhole conduit to position the perforation device at a plurality of spaced-apart locations within the downhole conduit, thereby facilitating formation of the plurality of perforations at the plurality of spaced-apart locations. The repeating at 290 further may include selectively rotating at least the trajectory-altering structure to define a desired angular perforation distribution within the downhole tubing and/or with the plurality of perforations.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It also is within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The systems and methods disclosed herein are applicable to the well drilling and/or completion industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What we claim is:

1. A perforation device configured to be positioned within a downhole conduit of downhole tubing, which extends within a wellbore that extends within a subterranean formation, and to form a plurality of perforations within the downhole tubing, the perforation device comprising:

a magazine configured to contain a plurality of cartridges;

a barrel extending between a breech, which is configured to receive a selected cartridge of the plurality of cartridges from the magazine, and a muzzle, wherein the selected cartridge includes a selected projectile, and further wherein the muzzle is configured, upon firing of the selected cartridge, to permit the selected projectile to exit the barrel at a muzzle velocity and with a muzzle trajectory;

a trajectory-altering structure configured to receive the selected projectile from the muzzle and to act upon the selected projectile such that, upon exiting the trajectory-altering structure, the selected projectile defines a modified trajectory that differs from the muzzle trajectory; and an action configured to selectively and sequentially:

(i) transfer the selected cartridge from the magazine to the breech of the barrel; and (ii) fire the selected cartridge to accelerate the selected projectile through the barrel;

wherein the magazine, the barrel, the trajectory-altering structure, and the action are operatively coupled to one another and configured to move as a unit within the downhole conduit.

2. The perforation device of claim 1, wherein the perforation device is an elongate perforation device that defines an elongate perforation device axis extending between an uphole end and an opposed downhole end of the perforation device, and further wherein the muzzle trajectory is oriented along the elongate perforation device axis.

3. The perforation device of claim 2, wherein the perforation device defines a length, as measured between the uphole end and the downhole end of the perforation device, that is at least 25 centimeters and at most 1000 centimeters.

4. The perforation device of claim 1, wherein the muzzle trajectory and the modified trajectory define a modification angle of at least 45 degrees and at most 135 degrees therebetween.

5. The perforation device of claim 1, wherein the trajectory-altering structure includes a bent tubular trajectory-altering structure that extends from the muzzle of the barrel.

6. The perforation device of claim 5, wherein at least one of:

(i) the bent tubular trajectory-altering structure is operatively attached to the barrel; and (ii) the bent tubular trajectory-altering structure and the barrel define a unitary structure.

7. The perforation device of claim 5, wherein the bent tubular trajectory-altering structure defines an average structure transverse cross-sectional area, wherein the barrel defines an average barrel transverse cross-sectional area, and further wherein the average barrel transverse cross-sectional area is less than 90% of the average structure transverse cross-sectional area.

8. The perforation device of claim 1, wherein the trajectory-altering structure includes a ricochet-inducing structure configured to direct the projectile from the muzzle trajectory to the modified trajectory.

9. The perforation device of claim 8, wherein the ricochet-inducing structure includes a ricochet-inducing surface that is oriented at a ricochet-inducing surface angle relative to the muzzle trajectory, wherein the ricochet-inducing surface angle is at least 15 degrees and at most 75 degrees.

10. The perforation device of claim 1, wherein the selected cartridge defines a projectile direction, which extends from a head of the selected cartridge toward the selected projectile.

11. The perforation device of claim 10, wherein, prior to being transferred from the magazine to the breech of the barrel, the projectile direction of the selected cartridge is at least substantially perpendicular to the muzzle trajectory, and further wherein the perforation device includes a cartridge rotating structure configured to rotate the selected cartridge such that the projectile direction is at least substantially parallel to the muzzle trajectory prior to transfer of the selected cartridge to the breech of the barrel.

12. The perforation device of claim 1, wherein the perforation device further includes a gas supply structure configured to provide a gas stream to the barrel to at least one of:

(i) restrict entry of wellbore fluid into the barrel; and (ii) maintain a gaseous environment between the breech of the barrel and the muzzle of the barrel.

13. The perforation device of claim 1, wherein the perforation device further includes a rotation structure configured to selectively rotate at least the trajectory-altering structure, within the downhole conduit, to facilitate formation of a plurality of perforations within the downhole tubing that defines a desired angular perforation distribution, wherein the rotation structure is configured to selectively vary an orientation of the modified trajectory, relative to the downhole tubing, when the perforation device is positioned within the downhole conduit.

14. The perforation device of claim 1, wherein the perforation device is an elongate perforation device that defines an elongate perforation device axis extending between an uphole end and an opposed downhole end of the perforation device, and further wherein the perforation device defines a maximum transverse cross-sectional dimension, as measured perpendicular to the elongate perforation device axis, wherein the maximum transverse cross-sectional dimension is less than 20 centimeters.

15. The perforation device of claim 1, wherein the perforation device further includes a casing collector configured to retain a plurality of casings, which includes a selected casing, subsequent to firing of the selected cartridge.

16. The perforation device of claim 1, wherein the action is configured to selectively fire the selected cartridge responsive to receipt of a firing signal.

17. The perforation device of claim 16, wherein the firing signal includes at least one of:

(i) an electronic firing signal;

(ii) a mechanical firing signal;

(iii) a wireless firing signal;

(iv) a predetermined pressure pulse sequence within wellbore fluid that surrounds the perforation device within the wellbore; and (v) a predetermined mechanical force sequence applied to the perforation device by an umbilical.

18. A method of perforating downhole tubing extending within a wellbore that extends within a subterranean formation, the method comprising:

positioning a perforation device within a downhole conduit, which is defined by the downhole tubing; and sequentially:

(i) transferring a selected cartridge of a plurality of cartridges from a magazine of the perforation device to a breech of a barrel of the perforation device;

(ii) firing the selected cartridge to accelerate a selected projectile of the selected cartridge from a muzzle of the barrel at a muzzle velocity and with a muzzle trajectory;

(iii) altering the muzzle trajectory of the selected projectile with a trajectory-altering structure such that, upon exiting the trajectory-altering structure, the selected projectile has a modified trajectory that differs from the muzzle trajectory; and (iv) penetrating the downhole tubing with the selected projectile to form a perforation in the downhole tubing.

19. The method of claim 18, wherein the positioning includes flowing the magazine, the barrel, and the trajectory-altering structure as a unit within the downhole conduit.

20. The method of claim 18, wherein the trajectory-altering structure includes a bent tubular, and further wherein the altering includes conveying the selected projectile through the bent tubular.

21. The method of claim 18, wherein the trajectory-altering structure includes a ricochet-inducing structure, and further wherein the altering includes ricocheting the selected projectile off of the ricochet-inducing structure.

22. The method of claim 18, wherein the method further includes providing a gas stream to the barrel.

23. The method of claim 18, wherein the perforation is a first perforation, and further wherein the method includes repeating at least the positioning, the transferring, the firing, the altering, and the penetrating a plurality of times to form a plurality of perforations in the downhole tubing.

24. The method of claim 23, wherein, during the repeating, the method further includes selectively rotating at least the trajectory-altering structure to define a desired angular perforation distribution with the plurality of perforations.

* * * * *